US007172515B2

(12) United States Patent
Costa et al.

(10) Patent No.: US 7,172,515 B2
(45) Date of Patent: Feb. 6, 2007

(54) GOLF SWING PLANE TRAINING METHOD AND APPARATUS

(76) Inventors: Brian E Costa, 1408 Doubletree Trl, Flower Mound, TX (US) 75028; Tom P Ward, P.O. Box 820934, Fort Worth, TX (US) 76182

( * ) Notice: Subject to any disclaimer, the term of this patent is extended or adjusted under 35 U.S.C. 154(b) by 0 days.

(21) Appl. No.: 10/708,697

(22) Filed: Mar. 18, 2004

(65) Prior Publication Data

US 2005/0209015 A1 Sep. 22, 2005

(51) Int. Cl.
*A63B 69/36* (2006.01)

(52) U.S. Cl. ..... 473/261; 473/264; 473/265

(58) Field of Classification Search ..... 473/257, 473/261, 264, 265, 219; 211/198, 201, 204, 211/206, 175
See application file for complete search history.

(56) References Cited

U.S. PATENT DOCUMENTS

| | | | | | |
|---|---|---|---|---|---|
| 389,336 | A | * | 9/1888 | Stunden | 211/198 |
| 720,406 | A | | 2/1903 | Clifford | |
| 1,637,339 | A | * | 8/1927 | Glennon et al. | 473/265 |
| 3,375,010 | A | | 3/1968 | Panza | |
| 3,482,838 | A | * | 12/1969 | Gibson et al. | 473/264 |
| 3,583,707 | A | | 6/1971 | Fujimoto | |
| 3,753,563 | A | * | 8/1973 | Previte, Jr. | 473/265 |
| 3,806,133 | A | | 4/1974 | Cork | |
| 3,942,802 | A | | 3/1976 | Wright | |
| 4,261,469 | A | * | 4/1981 | Stone | 211/119.1 |
| 4,736,952 | A | | 4/1988 | Taft | |
| 4,869,510 | A | * | 9/1989 | Battersby | 473/264 |
| 4,927,152 | A | | 5/1990 | Graham | |
| 5,013,044 | A | | 5/1991 | Hesselbart | |
| 5,375,833 | A | | 12/1994 | Marier | |
| 5,720,669 | A | | 2/1998 | Pearson | |
| 5,776,007 | A | * | 7/1998 | Kendall et al. | 473/258 |
| 5,899,816 | A | | 5/1999 | Pearson | |
| 6,048,273 | A | * | 4/2000 | Clement | 473/261 |

(Continued)

OTHER PUBLICATIONS

Ward, Tom, et al., Golf The Game For Life, The 2001 Official Guide to Junior Golf, 2001, pp. 90-93.

(Continued)

*Primary Examiner*—Raleigh W. Chiu
(74) *Attorney, Agent, or Firm*—Fish & Richardson P.C.; Ross Spencer Garsson

(57) ABSTRACT

A golf swing plane training method and apparatus consisting a pair of elastic cords suspended above the ground faithfully defining a cross section of the swing plane. The elastic cords are parallel to each other and approximately parallel to the ground. The plane formed by the two elastic cords is substantially perpendicular to the proper swing plane at a height ranging from the level of the knees to the level of the waist of a golfer at address. The height of the elastic cords is slidably adjustable to accommodate the full range of golf clubs and golfers of varying sizes and heights. The distance between the elastic cords can be altered to accommodate golfers of different skill levels. As the skill level of the golfer improves, the elastic cords can be located closer together. A method for using the apparatus is submitted to provide the golfer with checkpoints that indicate a proper swing plane. In addition, if the golf club is swung incorrectly, the trainer restricts completion of that swing.

20 Claims, 8 Drawing Sheets

U.S. PATENT DOCUMENTS

| | | | | |
|---|---|---|---|---|
| 6,165,079 | A | 12/2000 | Czaja | |
| 6,346,050 | B1 | 2/2002 | Larson | |
| 6,695,710 | B2 * | 2/2004 | Yamada | 473/265 |
| 6,755,751 | B2 * | 6/2004 | Chapman | 473/229 |
| 2002/0173370 | A1 * | 11/2002 | Chapman | 473/258 |
| 2003/0027657 | A1 * | 2/2003 | Yamada | 473/265 |

OTHER PUBLICATIONS

Ward, Tom, Tom Ward Seeker of the Lost Swings, 2002, Adventurous Golf Productions, Inc., Fort Worth, Texas.

* cited by examiner

GOLF SWING PLANE TRAINING METHOD AND APPARATUS

BACKGROUND OF INVENTION

1. Field of Invention

This invention relates to the field of golf. More specifically, this invention is directed toward an apparatus and method for improving a golfer's swing.

2. Description of Prior Art

Golf is a sport replete with equipment, methods, and training aids aimed at providing tools to improve the golf swing. Many of the trainers attempt to direct a golf club by means of a physical guide that actually has contact with the golf club as typified by U.S. Pat. No. 3,583,707 to Fujimoto (1971), U.S. Pat. No. 3,806,133 to Cork (1974), and U.S. Pat. No. 6,165,079 to Czaja (2000). While these devices are beneficial, they do not provide the opportunity for the golfer to learn the "feel" of the correct swing generated by his own coordination. Many devices address only a portion of the entire golf swing. U.S. Pat. No. 3,482,838 to Gibson et al. (1969) provides guidance for the follow through only. U.S. Pat. No. 4,927,152 to Graham (1990), U.S. Pat. No. 5,720,669 to Pear-son (1998), U.S. Pat. No. 3,375,010 to Panza (1968) U.S. Pat. No. 5,899,816 to Pearson (1999), U.S. Pat. No. 5,375,833 to Marier (1994), and U.S. Pat. No. 3,942,802 to Wright (1976) provide a physical and visual reference for only the bottom portion of the downswing. Several inventions comprise an apparatus for either one side of the swing plane or another, as documented in U.S. Pat. No. 5,013,044 to Hesselbart (1991) and U.S. Pat. No. 6,346,050 to Larson (2002). U.S. Pat. No. 720,406 to Clifford (1903) concentrates on the backswing and follow-through motions, however, it provides no restriction for off-plane swings. U.S. Pat. No. 4,736,952 to Taft et al. (1988) deals with several issues, including alignment, address, back-swing, downswing, and follow through, but it does not provide feedback to the golfer about where an errant swing first went awry. U.S. Pat. No. 4,869,510 to Battersby (1989) encompasses many features of the aforementioned aids. However, it only addresses one side of the swing plane at a time. In addition, an instructor or individual very knowledgeable in the game is required to set it up correctly, as is common with many of the aforementioned patents. The set up is also time consuming, being that stakes need to be driven into the ground to secure the device. "Tom Ward, Seeker of the Lost Swings", Copyright 2002 by Tom Ward and Adventurous Golf Publications, Inc. proficiently describes a method for using and training on a device with a single cord suspended to provide a visual and physical reference of the outside of the swing plane.

SUMMARY OF INVENTION

It is an object of the present invention to provide a golf swing plane training method and apparatus for improving a golfers ball striking skills. It is well know in the field of golf that an "on plane" swing will produce significantly better results than an "off plane" swing. A swing that is consistently "on plane" will directly improve the consistency of the ball flight. Conversely, a swing that is "off plane" requires manipulations from the golfer in mid-swing that can easily result in errant shots. In the context of the present invention, a swing plane has two sides. The side closest to the golfer is the "inside" of the swing plane, and the side distant from the golfer is the "outside" of the swing plane. The present invention addresses both sides of the swing plane and all portions of the complete swing. Apparatus is easily configurable for golfers of varying capability, height, gender, and left-hand/right-hand orientation. In addition, the trainer will provide guidance on every golf club, including the putter and driver. The preferred embodiment of the invention is freestanding, to minimize set up time and improve portability. The preferred embodiment is also collapsible to facilitate transportation to and from a driving range or practice facility.

The present invention consists of two elastic cords suspended parallel to the ground at a height ranging from the level of the knees to the level of the waist of a golfer at address. The cords embody a visual and physical representation of a cross section of a golf swing plane. The elastic cords are oriented substantially perpendicular to the swing plane. The distance between the elastic cords can be increased and decreased according to the skill of the golfer. The distance between the ground and the elastic cords is slidably adjustable to accommodate various clubs and golfers of different heights. The preferred embodiment of the apparatus provides sufficient structure to pre-load the elastic cords with tensile forces. The tension in the elastic cords will give the appearance of relatively straight lines with minimal sagging. Should the golfer produce an errant swing, the elastic cords will interfere with the complete swing. The resulting interference will significantly increase the loads placed on the elastic cords. The structure is sturdy enough to withstand the increased loads. The elastic properties of the cords will absorb a large portion of the force exerted when a golf club interferes with elastic cords. The same elastic properties will help minimize damage incurred by golf clubs and the golfer.

If a golf club is swung correctly, the trainer remains passive, the golfer will be able to complete the swing with no interruption. However, if the golfer fails to keep the club "on plane" during the swing, the elastic cords will restrict the swing. On a slightly "off plane" swing, the golf club will glance off the elastic cords alerting the golfer of the error. The interference between the elastic cords and the golf club provides an instantaneous indication of an errant swing. The point at which the device interferes with the golf club indicates the source of the problem.

The present invention will benefit a novice golfer as well as a highly skilled golfer. The novice golfer will benefit from the visual reference defining the swing plane. The novice golfer will also receive the benefit of learning the body motions required to swing a golf club on plane. The highly skilled golfer will benefit from the real-time instantaneous feedback provided by the trainer. A highly skilled golfer generates a swing speed that is very difficult for the human eye to track and discern the proper club path. The apparatus will provide feedback to golfers with any swing speed. The principals employed by the invention are simple enough to allow a novice golfer to set up and utilize it with or without assistance from an expert.

As the golfer improves, the elastic cords can be secured to the apparatus in a configuration where the distance between them is reduced. This action will increase the difficulty related to swinging a golf club in the apparatus without interference from the elastic cords. Another feature of the present invention is training the golfer to perform a draw (right to left ball flight for right handed golfers) and/or a cut (left to right ball flight). The methodology revealed for a full swing applies to partial swings as well. A golfer training on the apparatus can improve shots requiring a partial swing, typically an approach shot to a green. The process of maintaining the correct swing plane will improve consistency and control of shorter shots.

The foregoing features and advantages of current invention will be more fully described below with reference to the accompanying drawings.

DETAILED DESCRIPTION

Figure 1:
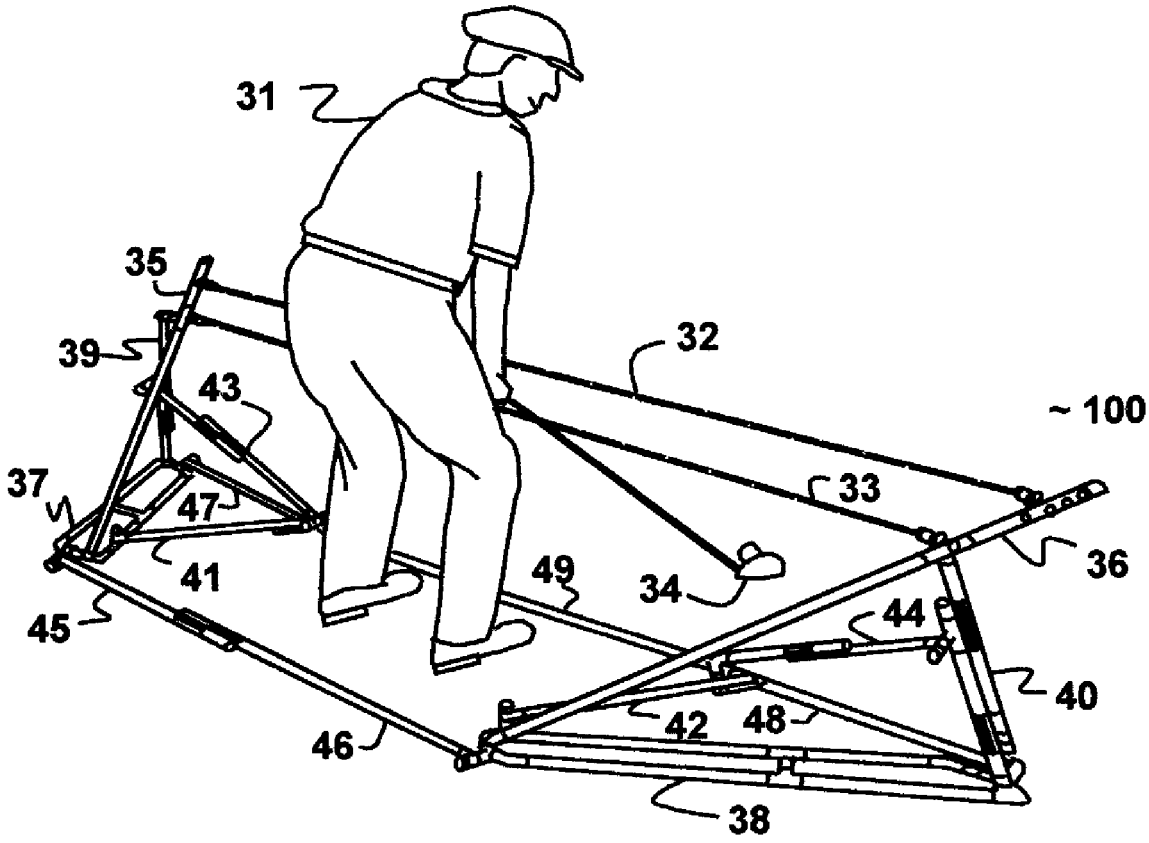
FIG. 1 is a perspective view from the back side of the apparatus of the invention illustrating a golfer at address.

Referring to FIG. 1, there is shown a golf swing plane training apparatus in accordance with the invention in the perspective view. The right hand and left hand portions of the apparatus are substantially mirror image. The hands of a golfer 31 at address are placed between inner elastic cord 33 and outer elastic cord 32. The elastic cord 32 and elastic cord 33 are oriented substantially perpendicular to the proper swing plane. Elastic cords 32 and 33 are suspended between first end attachment member 35 and second end attachment member 36. Each cord can be attached to a plurality of locations 50 (FIG. 2) along the forward end of first end attachment member 35 and second end attachment member 36. The distance between elastic cords 32 and 33 is determined by the selection from various locations 50.

Figure 2:
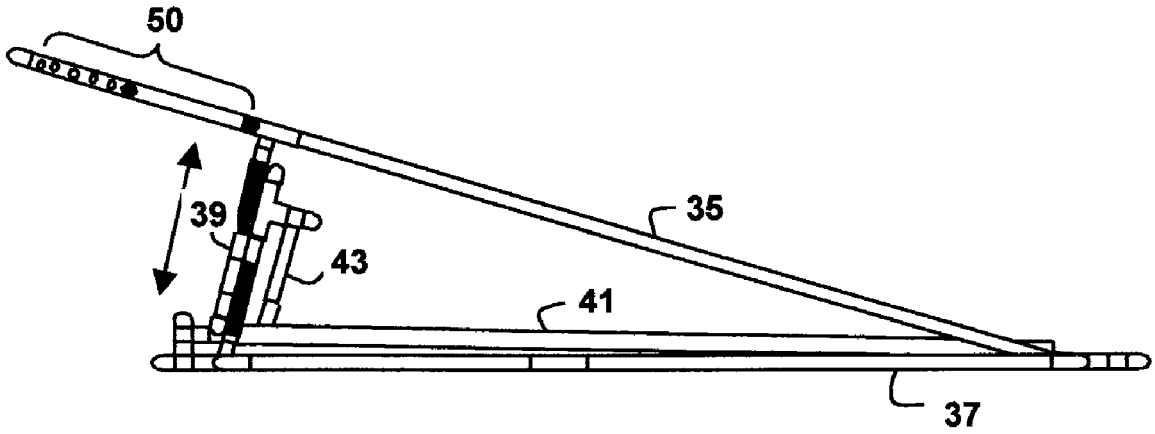
FIG. 2 is a side elevational view of the apparatus of the invention illustrating height adjustment.
Figure 8:
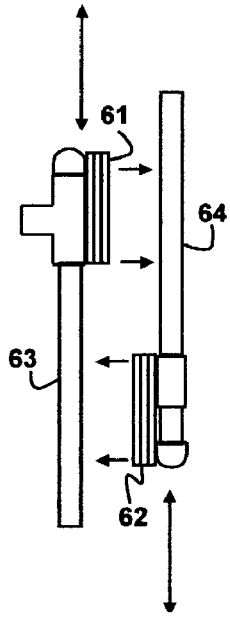
FIG. 8 is a side elevational view of a slidable clamp assembly.
Figure 5:
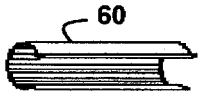
FIG. 5 is a perspective view of a snap clamp.
Figure 9:
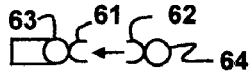
FIG. 9 is an end view of a slidable clamp assembly illustrated in FIG. 8.

First end attachment member 35 is pivotably secured to first base assembly 37 thus enabling first end attachment member 35 to be raised and lowered on the forward end as illustrated in FIG. 2. The distance the end attachment means is raised and lowered is controlled by vertical support means 39. Vertical support means 39 comprises an upper vertical support 64 and a lower vertical support 63, as shown in FIG. 8. A typical snap clamp 60 is illustrated in FIG. 5. A snap clamp 62 is attached to free end of upper support 64 and snap clamp 61 is attached to free end of lower vertical support 63 (FIG. 8). The cross section of snap clamp 61 forms a "C" shape that can be clamped to a pipe of corresponding diameter as illustrated by the end view of the vertical support in FIG. 9 . Snap clamp 62 of upper support 64 can be secured to a plurality of locations below snap clamp 61 of the lower support 63. Conversely, snap clamp 61 of lower support 63 can be secured to a plurality of locations above snap clamp 62 of upper support 64. A releasable and slidable first clamp assembly has been formed after both clamps have been secured to the opposing support member. Second vertical support means 40 incorporates a second clamp assembly to form similar connectivity.

Figure 3:
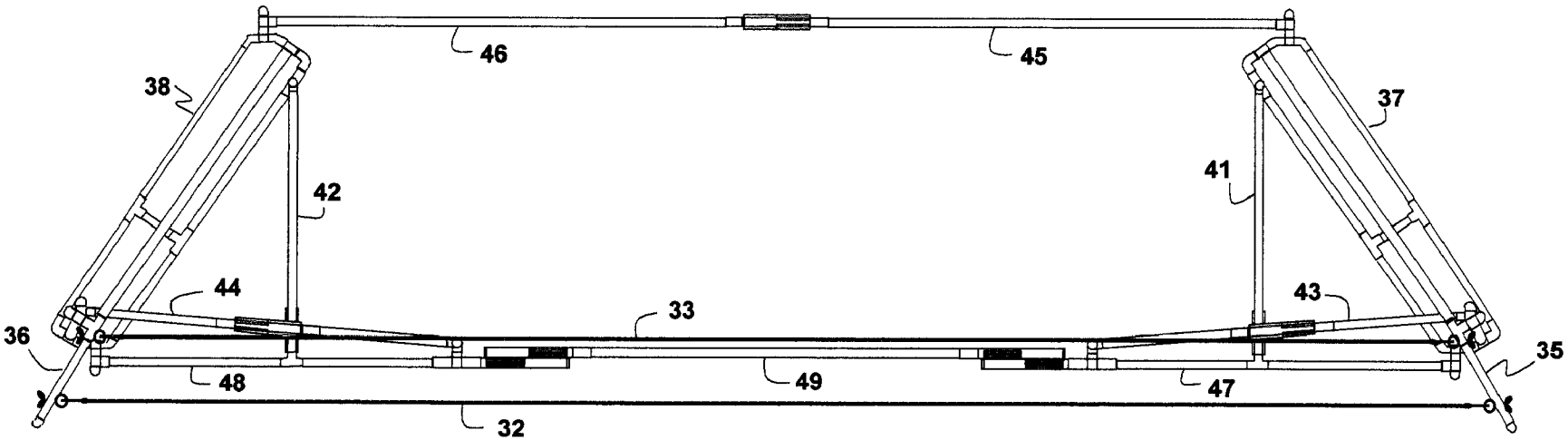
FIG. 3 is a plan view of the apparatus of the invention.
Figure 6:
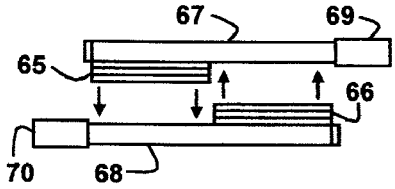
FIG. 6 is a side view of a clamp assembly.
Figure 7:
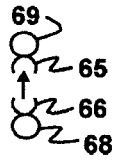
FIG. 7 is an end view of a clamp assembly illustrated in FIG. 6.

Referring to FIG. 3, there is shown a golf swing plane training apparatus in accordance with the invention in the top view. First base assembly 37 is separated from second base assembly 38 at a predetermined distance sufficient to accommodate a full swing with a driver golf club. Forward spreader means comprises a first forward articulating leg 47 secured to forward end of first base assembly 37 and a second forward articulating leg 48 secured to forward end of second base assembly 38. The first forward leg 47 is connected to second forward leg 48 with a third clamp assembly 49. A side view of a typical releasable clamp assembly is illustrated in FIG. 6 and an end view of the typical clamp assembly is illustrated in FIG. 7. A snap clamp 66 is attached to free end of pipe section 68 and opposing snap clamp 65 is attached to the free end of opposing pipe section 67. A fitting 70 with a slightly larger diameter than pipe section 68 is connected to pipe section 68 allowing just enough clearance to attach opposing snap clamp 65 of opposing pipe section 67. Clearance between fitting 70 and snap clamp 66 is minimized to prevent slidability. Fitting 69 with a slightly larger diameter than pipe section 67 is connected to pipe section 67 allowing just enough clearance to attach opposing snap clamp 66 of opposing pipe section 68. Clearance between fitting 69 and snap clamp 65 is minimized to prevent slidability. A releasable clamp assembly has been formed after both clamps have been secured to opposing pipe sections.

Figure 10:
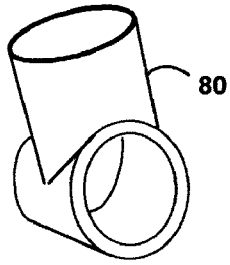
FIG. 10 is a perspective view of a pivot fitting.
Figure 12:
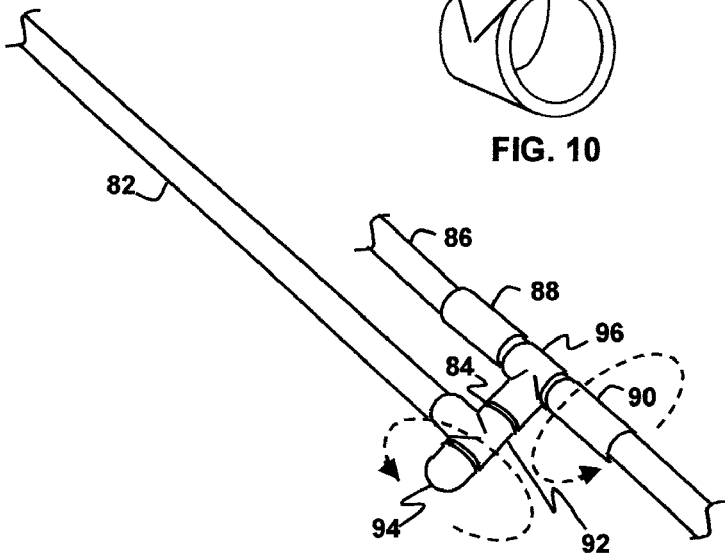
FIG. 12 is a perspective view of an articulating joint illustrating movement.
Figure 11:
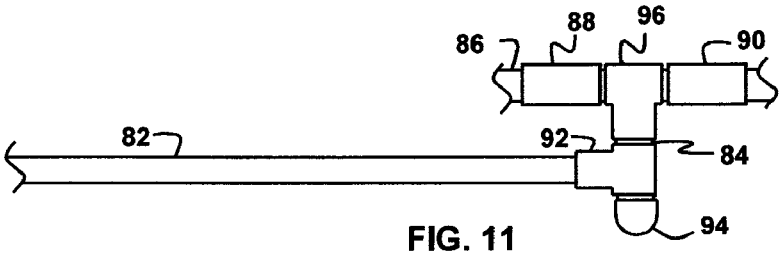
FIG. 11 is a plan view of an articulating joint.

First forward articulating leg 47 is secured to first base assembly 37 by means of a typical articulating joint (FIG. 3). A top view of a typical articulating joint is shown in FIG. 11. A perspective view of a typical articulating joint is shown in FIG. 12 illustrating movement. A typical pivot fitting 80 is shown in FIG. 10. Pipe section 82 is attached to pivot fitting 92. Pivot fitting 92 is rotably mounted to short pipe section 84. Pipe section 84 is attached to complementary pivot fitting 96. End cap 94 is attached to open end of pipe section 84 to prevent slippage. Pivot fitting 96 is rotably mounted to pipe section 86. Fitting 88 is mounted adjacent to pivot fitting 96. A complementary fitting 90 is mounted opposite fitting 88 and adjacent to pivot fitting 96. Distance between fitting 88 and complementary fitting 90 is minimized to keep pivot fitting 96 from moving in either direction along pipe section 86. Second forward articulating leg 48 is secured to second base assembly 38 by similar typical articulating joint (FIG. 3).

Aft spreader means comprises a first aft articulating leg 45 secured to aft end of first base assembly 37 and a second aft articulating leg 46 secured to aft end of second base assembly 38 (FIG. 3). First aft leg 45 is secured to second aft leg 46 with a fourth clamp assembly similar to typical clamp assembly shown in FIG. 6. First aft leg 45 is secured to first base assembly 37 by means of a typical articulating joint (FIG. 11). Similarly, second aft leg 46 is secured to second base assembly 38 by means of a typical articulating joint.

Distance and orientation between first forward articulating leg 47 and first base assembly 37 is controlled by first spacer member 41 (FIG. 3). First spacer member 41 is pivotably secured to aft end of first base assembly 37. A typical pivot fitting 80 (FIG. 10) is used in a vertical position to form the pivotable joint. Free end of first spacer member 41 is releasably attached to an inner position on first articulating leg 47 by means similar to typical clamp assembly as shown in FIG. 6. A triangular shape has been formed between first spacer member 41, first base assembly 37, and first forward articulating leg 47 once first spacer member 41 has been attached to first forward articulating leg 47. Distance and orientation between second forward articulating leg 48 and second base assembly 38 is controlled by second spacer member 42 connected in a manner similar to first spacer member 41.

Figure 4:
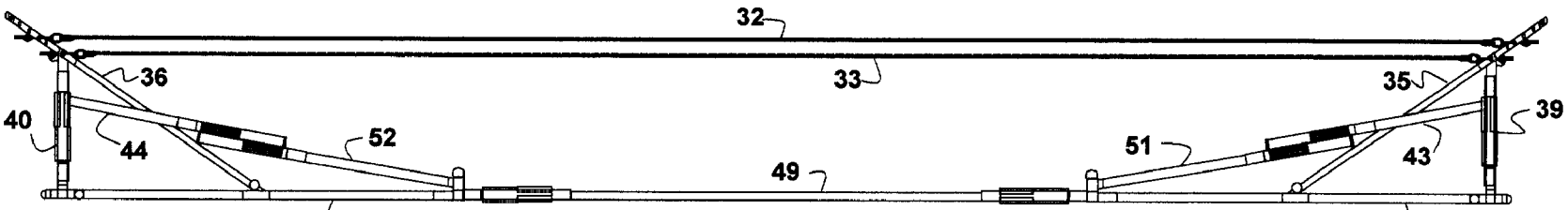
FIG. 4 is a front elevational view of the apparatus of the invention.

Referring to FIG. 4, there is shown a golf swing plane training apparatus in accordance with the invention in the front view. A first brace means and a second brace means are employed to offset moment arm forces generated by tension exerted by outer elastic cord 32 and inner elastic cord 33. First brace means comprises a first outer brace member 43 and a first inner brace member 51. First outer brace member 43 is pivotably attached to upper end of lower support member of vertical support means 39. First inner brace member 51 is pivotably attached to inner portion of first forward articulating leg 47. First outer brace member 43 is releasably attached to first inner brace member 41 by means of a typical clamp assembly (FIG. 6). Second brace means comprises a second outer brace member 44 and a second inner brace member 52. Second outer brace member 44 is pivotably attached to upper end of lower support member of vertical support means 40. Second inner brace member 52 is pivotably attached to inner portion of second forward articulating leg 48. Second outer brace member 44 is releasably attached to second inner brace member 52 by means of a typical clamp assembly (FIG. 6).

The following provides a method for using the current invention:

The golf swing plane training apparatus 100 (FIG. 1) of the current invention can be used in a variety of places. For example, the apparatus can used on natural turf. A common result of a proper swing is for the club head to take a divot, or piece of turf, at the bottom of the downswing. Given that the device is portable and freestanding, it is very easy to reposition to an undamaged area. An alternative to using the device directly on natural turf, is to set the apparatus up on an area of artificial turf. The artificial turf can be laid either outdoors or indoors, providing additional options for places to practice. Once the golf swing plane training apparatus has been assembled in the afore-mentioned form, it is ready for either a right-handed or left-handed golfer. Inner elastic cord 33 can be attached to location closest to golfer 31 selected from multiple locations 50 (FIG. 2). Outer elastic cord 32 can be attached to location most distant of golfer 31 selected from multiple locations 50. First end attachment member 35 and second end attachment member 36 can be raised and lowered by simply sliding the members up or down on first vertical support means 39 and second vertical support means 40. An effective height for most golfers is just below the hands of golfer 31 in the address position. This will be close to the intersection of the club grip and the club shaft.

Figure 14:
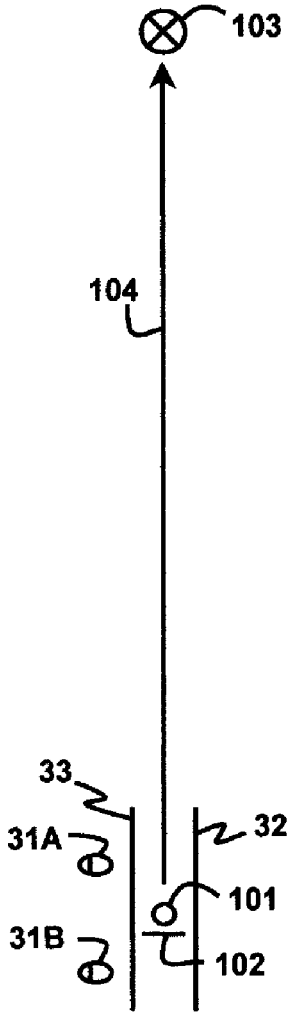
FIG. 14 is an illustration depicting an orientation to generate a straight shot.

FIG. 14 illustrates an orientation to hit a straight shot. Golfer 31 can orient left foot 31A (for right handed golfer) and right foot 31B substantially parallel to target line 104. Clubface 102 should be aligned square to golf ball 101 (or imaginary golf ball) and aimed directly at target 103. The golf swing training apparatus can be oriented such that inner elastic cord 33 and outer elastic cord 32 are substantially parallel to target line 104 and feet 31A, 31B. A common address position can be achieved by placing the feet 31A, 31B approximately shoulder width apart. A good posture can be realized by bending at the waist with the knees slightly bent to a position where the arms hang freely. From this position, the cords 32,33 can be adjusted accordingly. One height setting will typically accommodate several clubs of similar length. For example, the 6-iron, 5-iron, and 4-iron can use the same height setting. The apparatus is now ready for practice swings. Golfer 31 may swing with or without practice balls.

This method of using the golf swing plane training apparatus comprises six checkpoints employed to verify a proper "on plane" swing: address, backswing, downswing, point of contact, follow through, and finish. The apparatus will remain passive if golfer 31 completes the swing "on plane". However, if the golf club moves "off plane" during the swing, the apparatus will interfere, thus alerting golfer 31 to the location of the error. The corrections required for each error can be numerous and can vary substantially from one golfer to the next. Adjustments can be made to: foot position, grip, stance, spine angle, head position, timing, swing thought, or any other factor that can affect a golf swing.

The first checkpoint verifies proper address position. Golfer 31 can assume the proper address position with the golf club shaft resting substantially equidistant between inner elastic cord 33 and outer elastic cord 32. Golfer 31 can simply move both feet closer to or further away from inner elastic cord 33 until proper address position is achieved.

The second checkpoint verifies that the backswing is "on plane". If the golfer strikes inner cord 33 on the backswing, he has come to far inside. This usually results from flipping the wrists in an attempt to create an inside to out swing path. On the other hand, if the outer cord 32 restricts the club on the backswing, the golfer has taken the club back to far outside.

The third checkpoint verifies that the downswing is "on plane". If the golfer hits outer elastic cord 32 on the downswing, he has come "over the top". This is the most common error creating a slice (left to right ball flight for right handed golfer). Conversely, if the golfer strikes inner elastic cord 33 on the downswing he has turned too far inside. An "inside to out" swing is generally desired to produce a draw (slight right to left ball flight for right handed golfer). If the golfer intends to hit a "draw", he can open his stance (move the left foot back) slightly. This will assist the golfer in producing a draw without interfering with the trainer, thus promoting the proper swing path.

The fourth checkpoint verifies point of ball contact. Since the apparatus can be used with or without a ball, the divot, or lack thereof, will be used to determine correct ball contact. The club head will strike the ball first and then the turf during a proper swing. The club head will leave a divot that starts slightly after the resting ball position (or imaginary ball position) and ends a few inches later. A deep divot or a divot that starts early indicates a "fat" swing. No contact with the turf or a divot that starts too far past the ball indicates a "thin" swing.

The fifth checkpoint verifies that the follow through is "on plane". If the follow through of the swing intercepts outer elastic cord 32, actual ball flight would likely result in a "push". This "push" should have minimal sidespin, since the club was on plane prior to this point. The resulting shot would be a ball hit straight, but to the right of the target (left of the target for left handed golfers). However, if the clubface was left open, the result will be a "slice". If the follow through of the swing intercepts inner elastic cord 33 actual ball flight would likely result in a pull or pull-hook.

This should shot could have considerable sidespin. The amount of sidespin would be proportional to how much the golfer flipped his wrists.

The sixth check point verifies the finish. By this point, the golfer has addressed the ball, cleared the elastic cords 32,33 on the backswing and downswing, taken a small divot, and cleared the elastic cords 32,33 on the follow through. Golfer 31 simply allows the club to come to rest behind him. His weight should be substantially on his left foot and his chest should be pointed at the target.

If golfer 31 can pass all six checkpoints without interfering with golf swing plane training apparatus 100, she has completed the swing "on plane". The use of this same swing with a golf ball will result in a good ball flight. Once golfer 31 can complete multiple swings without interfering with apparatus, she can move elastic cords 32,33 closer to one another by selecting different attachment locations 50. Muscle memory will improve with increasing the number of successful swings completed without interfering with apparatus 100 and passing all six check points.

When a different club is selected, golfer 31 simply verifies that elastic cords 32,33 are at the proper height, then practices swinging the club while passing all six checkpoints. In addition to training on a full swing, the apparatus 100 will train partial swings as well, using same methodology. With the exception of the putter, all other clubs ranging from wedges to drivers can be developed and used with the aforementioned method. The method for using the putter on apparatus 100 is similar to the aforementioned method, with some minor adjustments. Outer elastic cord 32 can be moved to attachment location 50 providing the shortest distance between inner elastic cord 33 and outer elastic cord 32. This setting will leave enough room for the putter shaft to pass back and forth between elastic cords 32,33. Given that a "putt" requires much less travel than the other golf clubs, there will be little interference from the apparatus 100. Golfer 31 can use his sense of feel to determine when he moved "off plane" with the putting stroke. Elastic cords 32,33 will rub the putter shaft when golfer 31 moves "off plane".

Figure 13:
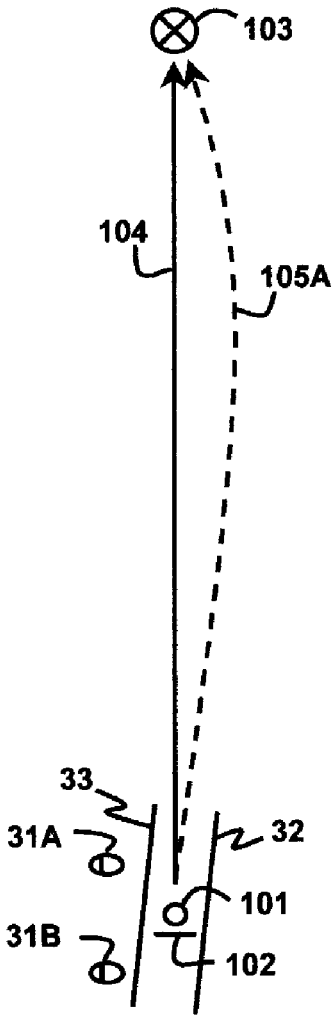
FIG. 13 is an illustration depicting an orientation to generate a "draw".
Figure 15:
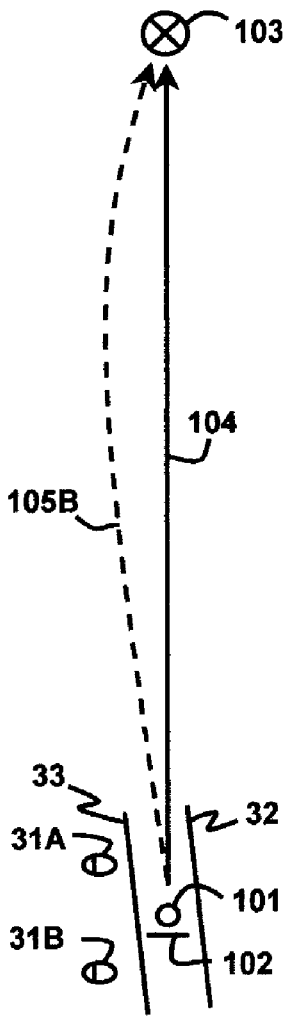
FIG. 15 is an illustration depicting an orientation to generate a "cut".

Additional ball flights can be achieved by changing the orientation of the golf swing plane training apparatus 100 with respect to the golfer 31 and target line 104. FIG. 13 illustrates an orientation to hit a "draw" (right to left ball flight for right handed golfer). Golfer 31 can orient left foot 31A and right foot 31B substantially parallel to target line 104. Clubface 102 should be aligned square to golf ball 101 (or imaginary golf ball) and aimed directly at target 103. The golf swing plane training apparatus 100 can be oriented such that inner elastic cord 33 and outer elastic cord 32 are turned clockwise with respect to golfers feet 31A, 31B and target line 104. The distance between left foot 31A and inner elastic cord 33 will be slightly increased and the distance between right foot 31B and inner elastic cord 33 will be slightly decreased. A successful swing will produce an "inside to out" club path while maintaining the correct plane. The resulting ball flight 105A will be one that starts right and curves to the left towards the target 103. FIG. 15 illustrates an orientation to hit a "cut" (left to right ball flight for right handed golfer). Golfer 31 can orient left foot 31A and right foot 31B substantially parallel to target line 104. Clubface 102 should be aligned square to golf ball 101 (or imaginary golf ball) and aimed directly at target 103. The golf swing plane training apparatus 100 can be oriented such that inner elastic cord 33 and outer elastic cord 32 are turned counterclockwise with respect to golfers feet 31A, 31B and target line 104. The distance between left foot 31A and inner elastic cord 33 will be slightly decreased and the distance between right foot 31B and inner elastic cord 33 will be slightly increased. A successful swing will produce an "outside to in" club path while maintaining the correct plane. The resulting ball flight 105B will be one that starts left and curves to the right towards the target 103.

Figure 16:
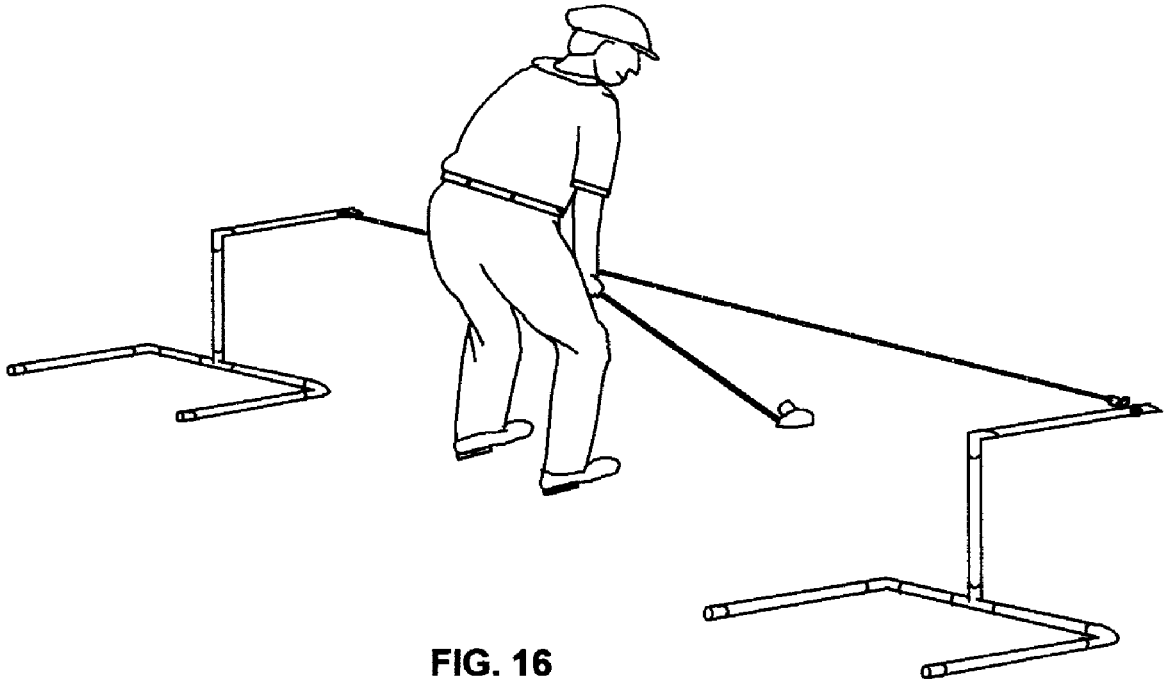
FIG. 16 is an alternate embodiment utilizing stands.
Figure 17:
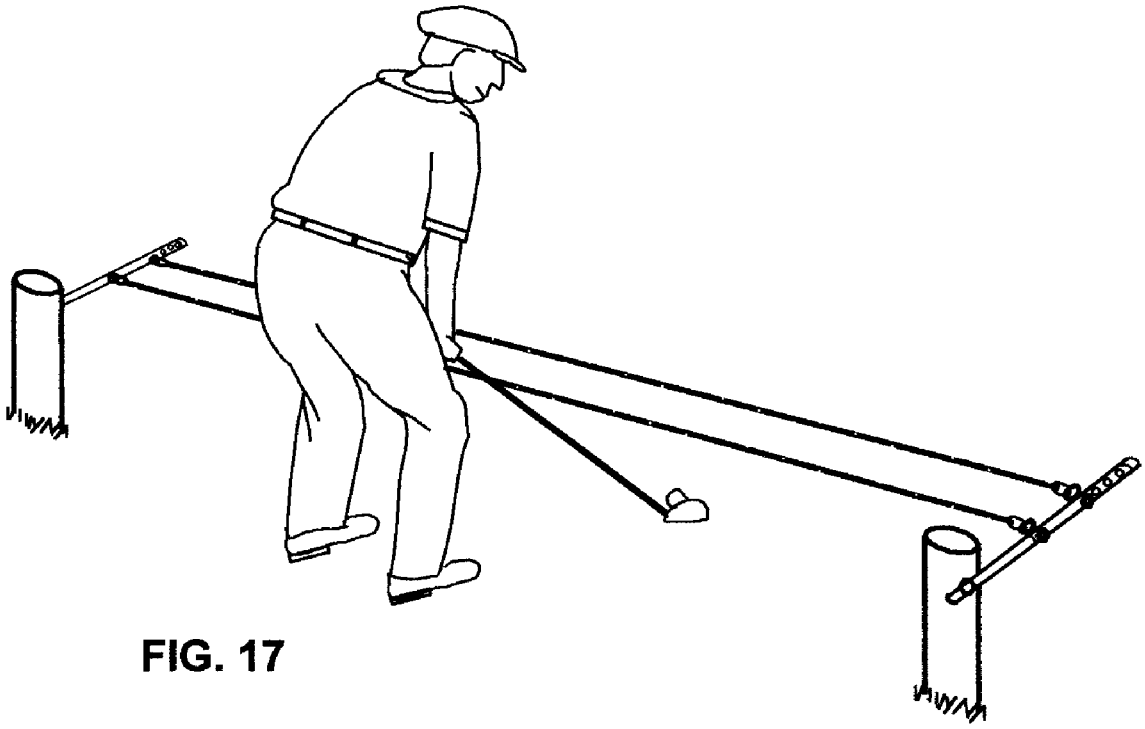
FIG. 17 is an alternate embodiment utilizing fixed posts.
Figure 18:
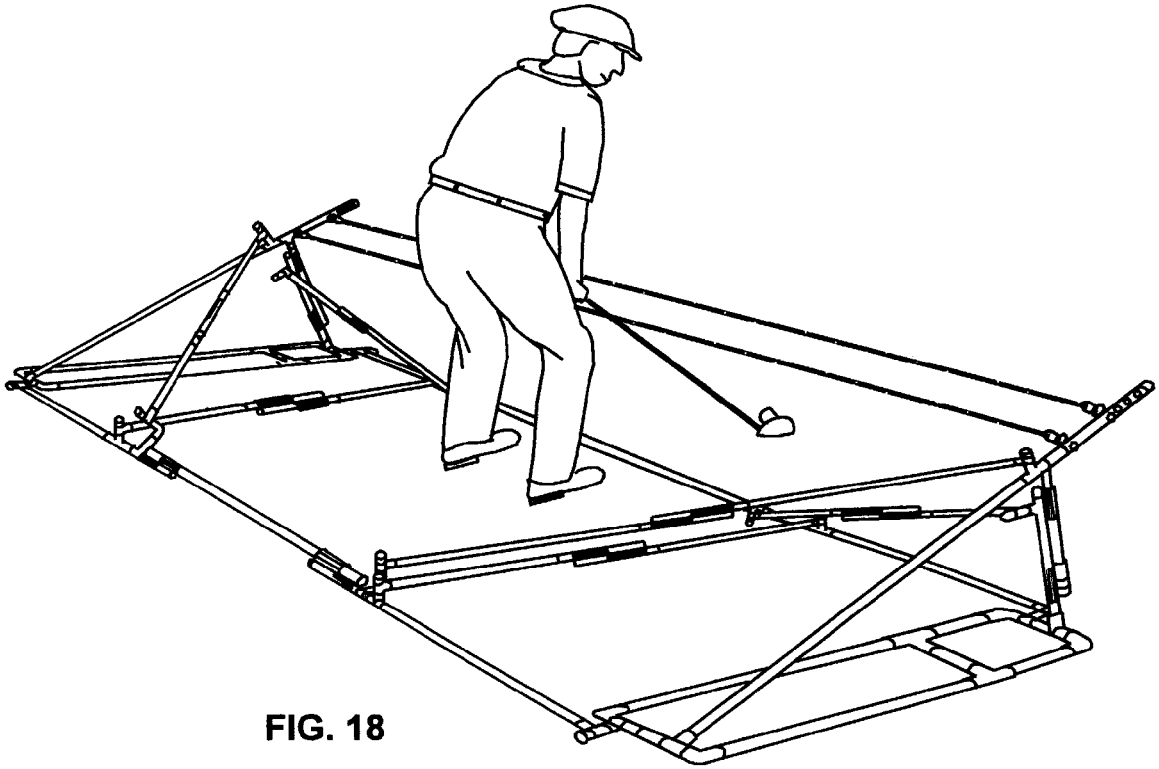
FIG. 18 is an alternate embodiment utilizing additional structure.

While the preferred embodiment of the current invention has been shown and described herein, it will be understood by those skilled in the art that changes can be made to the form and details without departing from the spirit of the invention. For example, FIG. 16 shows stands providing lateral attachment means for a single cord. This device is both freestanding and portable. A more permanent embodiment could consist of posts mounted in the ground with lateral attachment means supporting two elastic cords as shown in FIG. 17. Yet another embodiment could consist of a similar structure as the present invention, but with modified supports and additional members as shown in FIG. 18. The current invention may be combined with other training devices, most particularly, weighted training clubs, alignment means, and/or swing mats.

What is claimed is:

1. A golf swing plane training apparatus comprising:

(a) a pair of elastic cords suspended substantially parallel to the ground and parallel to each other at a predetermined height; and (b) a free standing frame structure suspending said pair of elastic cords in tension, wherein (i) said free standing frame structure comprises:

(A) a first end attachment member secured to a first base assembly and a first vertical support, (B) a second end attachment member secured to a second base assembly and a second vertical supports, and (C) a forward spreader member separating said first base assembly from said second base assembly at a predetermined distance sufficient to accommodate a full swing with a given golf club, and (ii) said free standing frame structure has sufficient reinforcement to allow the repeated urging and relieving of forces upon said pair of elastic cords from a multitude of directions, whereby a golfer can swing the given golf club between said pair of elastic cords to determine if said swing is correct.

2. The golf swing plane training apparatus of claim 1, further comprising means for adjusting the height of said elastic cords, whereby accommodating golfers of varying heights and golf clubs of different lengths.

3. The golf swing plane training apparatus of claim 1, further comprising a plurality of attachment locations along said first end attachment member and said second end attachment member, whereby distance between said elastic cords can be adjusted accommodating golfers of varying skill levels.

4. The golf swing plane training apparatus of claim 1, wherein said pair of elastic cords is substantially perpendicular to the intended swing plane of the golfer.

5. The golf swing plane training apparatus of claim 1, further comprising means for rendering said golf swing plane training apparatus collapsible, whereby improving portability.

6. The golf swing plane training apparatus of claim 1, further comprising an aft spreader member, a first spacer member, a second spacer member, a first brace member, and a second brace member, wherein (a) said apparatus is collapsible;

(b) said first base assembly is pivotably secured to aft end of said first attachment member adapted to rest on a practice surface;

(c) said second base assembly pivotably secured to aft end of said second attachment member adapted to rest on the practice surface;

(d) said first vertical support comprises (i) a first upper vertical support member pivotably secured to forward end of said first end attachment member, (ii) a first lower vertical support member pivotably secured to forward end of said base assembly, and (iii) a first clamp assembly, whereby said first upper vertical support member can be releaseably and slidably attached to said first lower vertical support member;

(e) said second vertical support comprises (i) a second upper vertical support member pivotably secured to forward end of said second end attachment member, (ii) a second lower vertical support member pivotably secured to forward end of said base assembly, and (iii) a second clamp assembly, whereby said second upper vertical support member can be releaseably and slidably attached to said second lower vertical support member;

(f) said forward spreader member comprises (i) a first forward articulating leg secured to forward end of said first base assembly, (ii) a second forward articulating end secured to forward end of said second base assembly, and (iii) a third clamp assembly, whereby said first forward articulating leg can be releaseably attached to said second forward articulating leg while resting on said practice surface;

(g) said aft spreader member separating said first base assembly from said second base assembly complimenting said forward spreader member and comprises (i) a first aft articulating leg secured to aft end of said first base assembly, (ii) a second aft articulating leg secured to aft end of said second base assembly, and (iii) a fourth clamp assembly, whereby said first aft articulating leg can be releasably attached to second aft articulating leg while resting on said practice surface;

(h) said first spacer member is pivotably attached to the aft end of said first base assembly and a fifth clamp assembly secured to an inner portion of said first forward articulating leg, whereby said first spacer member can be releasably attached to said first forward articulating leg;

(i) said second spacer member is pivotably attached to the aft end of said second base assembly and a sixth clamp assembly secured to an inner portion of said second forward articulating leg, whereby said second spacer member can be releasably attached to said second forward articulating leg;

(j) said first brace member comprises (i) a first outer brace member pivotably attached to an upper end of said first lower vertical support member, (ii) a first inner brace member pivotably attached to the inner portion of said first forward articulating leg, and (iii) a seventh clamp assembly, whereby said first outer brace member can be releasably attached to said first inner brace member; and (k) said second brace member comprises (i): a second outer brace member pivotably attached to an upper end of said second lower vertical support member, (ii) a second inner brace member pivotably attached to the inner portion of said second forward articulating leg, and (iii) an eighth clamp assembly, whereby said second outer brace member can be releasably attached to said second inner brace member.

7. The golf swing plane training apparatus of claim 6 fabricated with polyvinyl chloride (PVC) pipes, fittings, pivoting means, and clamping means.

8. The golf swing plane training apparatus of claim 1, further comprising an aft spreader member separating said first base assembly from said second base assembly complimenting said forward spreader member.

9. The golf swing plane training apparatus of claim 1, wherein the free standing frame structure is operable to be collapsible.

10. A golf swing plane training apparatus comprising:

(a) a first cord and a second cord, wherein each of the first cord and the second cord have a first end and a second end;

(b) a first base assembly having a first attachment member, wherein the first ends of the first cord and the second cord are attached to the first attachment member;

(c) a second base assembly having a second attachment member, wherein the second ends of the first cord and the second cord are attached to the second attachment member;

(d) a spreader connected to the first base assembly and the second base assembly such that the first cord and the second cord are suspended in tension substantially parallel to the ground and parallel to each other and form a swing plane through which a golfer can swing a given golf club between the first cord and the second cord during proper swinging of the golf club, wherein (i) the first attachment member and the second attachment member are operable for adjusting the separation distance between the first and second cords, and (ii) the first base assembly and the second base assembly are operable to adjust the height of the swing plane to accommodate for length of the given golf club and height of the golfer.

11. The golf swing plane training apparatus of claim 10, wherein the first attachment member and the second attachment member are operable to pivot the cords.

12. The golf swing plane training apparatus of claim 10, wherein the first attachment member and the second attachment member are operable to pivot the cords such that the cords form a plane that is substantially perpendicular to the swing plane.

13. The golf swing plane training apparatus of claim 10, wherein the golf swing plane training apparatus is collapsible.

14. The golf swing plane training apparatus of claim 10 further comprising a first brace member attached to the first base assembly and a second brace member attached to the second base assembly, wherein the first brace member and the second brace member are operable for offsetting forces generated from at least one of the first cord and the second cord.

15. A swing plane training apparatus comprising:

(a) a first cord and a second cord, wherein each of the first cord and the second cord have a first end and a second end;

(b) a first base assembly having a first attachment member, wherein the first ends of the first cord and the second cord are attached to the first attachment member;

(c) a second base assembly having a second attachment member, wherein the second ends of the first cord and the second cord are attached to the second attachment member;

(d) a spreader connected to the first base assembly and the second base assembly such that the first cord and the second cord are suspended in tension substantially parallel to the ground and parallel to each other and form a swing plane between the first cord and the second cord, wherein (i) the first attachment member and the second attachment member are operable for adjusting the separation distance between the first and second cords, and (ii) the first base assembly and the second base assembly are operable to adjust the height of the swing plane.

16. The swing plane training apparatus of claim 15, wherein the first base assembly and the second base assembly are operable to adjust the height of the swing plane to accommodate for height of the swinger.

17. The swing plane training apparatus of claim 15, wherein the first attachment member and the second attachment member are operable to pivot the cords.

18. The swing plane training apparatus of claim 15, wherein the first attachment member and the second attachment member are operable to pivot the cords such that the cords form a plane that is substantially perpendicular to the swing plane.

19. The swing plane training apparatus of claim 15, wherein the swing plane training apparatus is collapsible.

20. The swing plane training apparatus of claim 15 further comprising a first brace member attached to the first base assembly and a second brace member attached to the second base assembly, wherein the first brace member and the second brace member are operable for offsetting forces generated from at least one of the first cord and the second cord.

* * * * *